US006443762B1

(12) United States Patent
Lessig, III

(10) Patent No.: US 6,443,762 B1
(45) Date of Patent: Sep. 3, 2002

(54) POWER TOOL CORD RETAINER

(75) Inventor: William R. Lessig, III, Monkton, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/873,502

(22) Filed: Jun. 4, 2001

(51) Int. Cl.[7] ..... H01R 13/60
(52) U.S. Cl. ..... 439/528; 439/373
(58) Field of Search ..... 439/528, 478, 439/372, 373, 369, 577, 501; 30/388, 390; 248/52, 51; 191/12

(56) References Cited

U.S. PATENT DOCUMENTS

| | | | | | |
|---|---|---|---|---|---|
| 2,089,665 | A | * | 8/1937 | Roberts et al. | 439/373 |
| 4,875,879 | A | | 10/1989 | Bunyea et al. | 439/501 |
| 5,318,158 | A | | 6/1994 | Seasholtz | 191/12 R |
| 5,330,138 | A | | 7/1994 | Schlessmann | 248/52 |
| 5,454,729 | A | | 10/1995 | Wen-Te | 439/357 |
| 5,472,355 | A | * | 12/1995 | Wittmann | 439/373 |
| 5,573,422 | A | | 11/1996 | Lawliss | 439/448 |
| 5,620,336 | A | | 4/1997 | Worthing | 439/501 |
| 5,713,758 | A | | 2/1998 | Goodin et al. | 439/459 |
| 5,957,721 | A | | 9/1999 | Searle et al. | 439/501 |
| 6,012,940 | A | | 1/2000 | Wheeler | 439/369 |
| 6,058,612 | A | * | 5/2000 | Levya | 30/388 |
| 6,135,803 | A | | 10/2000 | Kovacik et al. | 439/369 |

* cited by examiner

*Primary Examiner*—P. Austin Bradley
*Assistant Examiner*—Alexander Gilman
(74) *Attorney, Agent, or Firm*—Harness, Dickey & Pierce, P.L.C.

(57) ABSTRACT

A power cord retaining device for a portable AC powered tool. A retaining member holds the power cord plug engaged with a mating AC power jack in the housing of the power tool. The retaining member slides in a slot within the housing of the power tool from an unlocked position to a locked position. In the locked position the power cord plug is held in place engaged with the mating power jack in the housing of the power tool. A release member having a biasing element locks the retaining member in place until it is manually unlocked by the user thereby permitting the retaining member to be moved slidably away from the power jack to permit removal of the plug from the power jack. An alternative embodiment incorporates a flexible release member which is biased into engagement with the retaining member, which therefore does not require a separate biasing element.

9 Claims, 3 Drawing Sheets

FIG. 1.
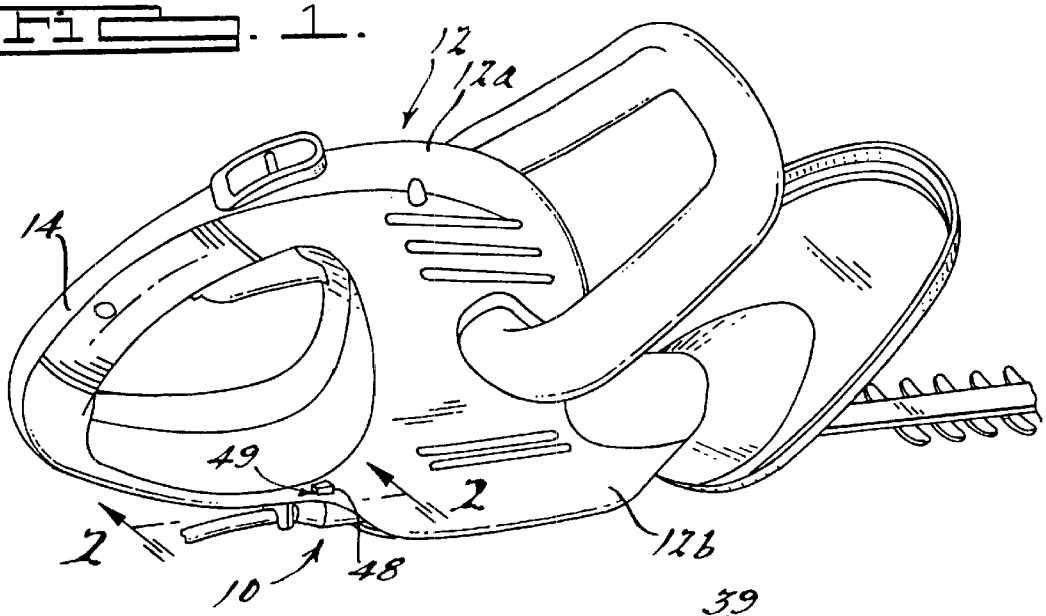
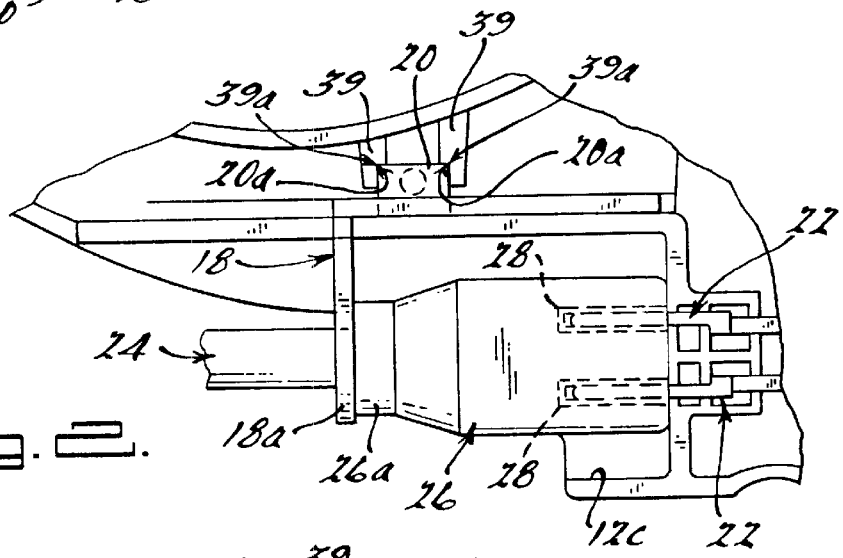
FIG. 2.
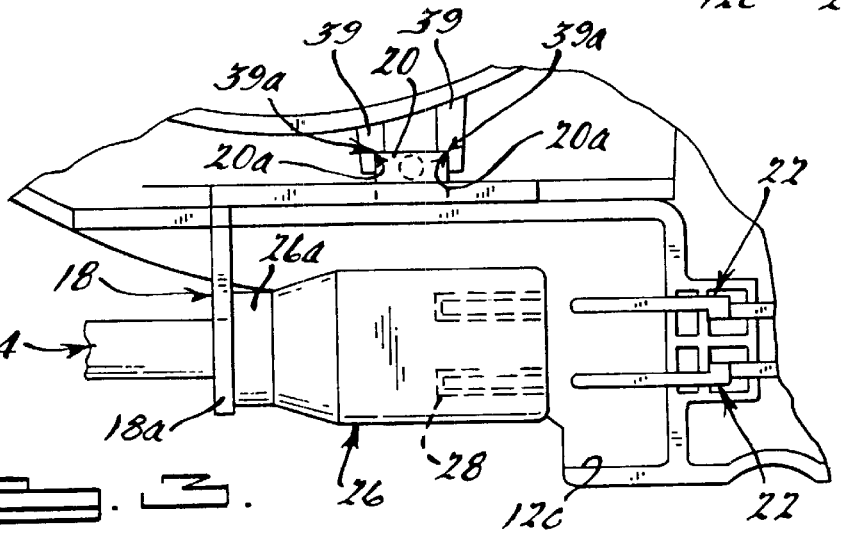
FIG. 3.

POWER TOOL CORD RETAINER

FIELD OF THE INVENTION

The present invention relates generally to power cord retention devices and more particularly to a power cord retention device for a portable AC powered tool.

BACKGROUND OF THE INVENTION

Many power tools require an extension power cord to connect the power tool to an AC power source. Portable AC powered tools such as hedge trimmers or string trimmers typically have male electrical contact blades in the housing of the power tool that connect to a female electrical receptacle plug at the end of an extension power cord. A common problem with portable AC powered tools is how to secure the extension power cord to the power tool in such a manner that it will not easily pull free during operation of the power tool. This is complicated by variations in the design of power cords that make one solution for securing a power cord not necessarily practical for all power cords. Further, some power tools are often operated in a way that strains the connection between the power cord and the AC power jack of the power tool. For example, an operator can carry a hedge trimmer with the extension power cord in tow thus causing an intermittent tugging or strain to the power cord connection. As a result of both the constant vibration of the tool together with the intermittent movement of the operator, the power cord can easily pull free of the tool's AC power jack.

Therefore, there is a need for a power cord retaining device that will operate with a variety of extension power cords and which will even more securely hold the extension cord to the power tool in spite of movement and vibration that is common in the operation of the power tool.

SUMMARY OF THE INVENTION

It is an object of the invention to provide a system for more securely holding a female plug of an extension power cord to a portable AC power tool. It is a further object to provide a system that is easily used by an operator, and which securely holds the power cord secured to the tool's AC power jack in spite of vibration and movement of the power tool during use thereof. An additional object is to provide a cord retaining system that will work with a variety of extension power cord types including a variety of differently shaped plugs. Another object of the invention is to provide a system that is easy to use and understand by its operator and which does not require the use of external tools or fasteners to secure the plug head of an extension power cord to an AC power jack of a power tool.

The present invention is directed to a cord retaining system associated with a housing of a portable power tool. The system provides a secure connection that can be quickly and easily effected between the power tool and the power cord so that the power cord cannot be accidentally pulled free from engagement with a power jack of the tool during use of the power tool.

In operation, the female plug at one end of the power cord is secured to the body or housing of the power tool by a retaining member that pulls the plug towards the body or housing of the power tool once the plug is engaged in a mating AC power jack disposed in the housing. In one preferred form, the retaining member comprises a linearly moveable yoke adapted to engage a plug of an AC power cord. A release member engages a portion of the yoke to hold the yoke in a locking position once the yoke has secured a plug of the power cord to the power jack. The retaining yoke holds the plug securely to the power tool by a locking system that can be easily disengaged by the power tool operator when it is necessary to uncouple the power cord from the tool. Advantageously, neither engagement of the yoke to the plug head or disengagement therefrom requires the use of any external tool(s) by the operator.

The retaining system incorporates locking components with opposing surfaces that when engaged prevent movement of the yoke in one longitudinal direction. In one preferred form the yoke includes one serrated surface, and the release member, disposed in proximity to the yoke, includes a mating serrated surface. The serrated surfaces are angled such that movement in one direction is allowed while attempted movement in the opposite direction causes the teeth of the serrated surfaces to engage and prevent movement. A biasing component is used to hold the opposing serrated surfaces together, therefore allowing longitudinal movement of the yoke only in the locking direction. By actuating the release member the serrated surfaces are forced apart, thus allowing the retaining yoke to move in an unlocking direction to a position allowing the operator to free the power cord from the retaining yoke and the power cord jack.

In one preferred embodiment the retaining yoke slides within a housing of the power tool, and the yoke includes a serrated surface on a side edge thereof. A spring forces the opposing surface edge of the release member against the serrated edge of the yoke.

In a second preferred embodiment the retaining yoke slides within the housing of the power tool and the retaining system includes a serrated surface on a top planar surface of the retaining yoke. The retaining yoke opposes a serrated surface on the release member, and a portion of the release member protrudes through a portion of the housing. The release member comprises a flexible member having a curved form. The curved form of the mechanism allows a biasing force to be exerted against the opposing serrated surface of the retaining yoke, thus preventing the yoke from moving in an unlocking direction unless the release member is engaged by the operator so as to lift it away from the serrated surface on the retaining yoke.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 1 is a perspective view of a hedge trimmer as an exemplary portable power tool with the power cord retaining system of the present invention incorporated into its housing;

FIG. 2 is a cross sectional side view of a portion of the power tool housing of FIG. 1, taken in accordance with section line 2—2 in FIG. 1, depicting the power cord retaining system in the locked position holding a power cord receptacle to a mating electrical power jack of the power tool;

FIG. 3 is a cross section of the power tool housing of FIG. 1 depicting the power cord retaining system in the unlocked position with a plug head of a power cord pulled back from the mating electrical receptacle in the housing;

DETAILED DESCRIPTION OF THE PREFERRED EMBODIMENTS

Figure 4:
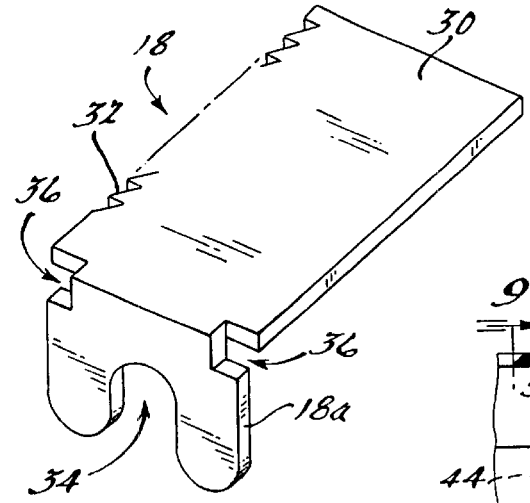
FIG. 4 is a perspective view of the power cord retaining member.

The following description of the preferred embodiment(s) is merely exemplary in nature and is in no way intended to limit the invention, its application, or uses.

In FIG. 1 an AC powered portable tool 12 incorporating a power cord retaining system 10 in accordance with a preferred embodiment of the present invention is shown. It will be appreciated immediately that while the power tool 12 is illustrated as a hedge trimmer, that the invention can be used with virtually any portable AC power tool, and therefore should not be construed as being limited to use with only hedge trimmers.

A housing 12*a* of the power tool 12 includes a handle 14 and a lower portion 12*b* at which the power cord retaining system 10 is located.

Referring to FIG. 2, the power cord retaining system 10 includes an L-shaped retaining member 18 having a yoke 18*a* and a release member 20. The system 10 is disposed in close proximity to a male AC power jack 22 which is disposed in a cavity 12*c* in the housing 12*a*, as is conventional with many portable AC power tools.

A power cord 24 has a female receptacle plug head 26 having female electrical receptacles 28 that engage the male AC power jack contact blades 22 disposed in the housing 12*a* of the power tool 12. The yoke 18*a* of the retaining member 18 holds the plug head 26 engaged with the AC power jack 22 by contact with a shoulder portion 26*a* of the plug head. FIG. 3 illustrates the power cord retaining system 10 in the unlocked (or open) position wherein the retaining member 18 is pulled away from the power jack 22, thus allowing the plug head 26 to be removed from the yoke 18*a*.

FIG. 4 illustrates the retaining member 18 in greater detail. The retaining member 18 has a planar, rectangular surface 30 extending perpendicularly to the yoke component 18*a*. The rectangular surface 30 also has a serrated edge 32. The yoke component 18*a* has an opening 34 large enough for the power cord 24 to fit through but small enough to prevent the plug head 26 at the end of the power cord from pulling through the yoke component.

Figure 8:
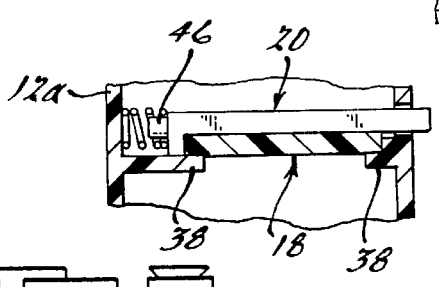
FIG. 8 is a partial cross sectional end view of the power cord retaining member and release member taken in accordance with section line 8—8 in FIG. 6 with the release member in the engaged position.
Figure 9:
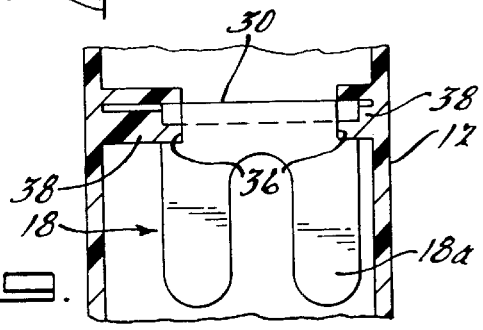
FIG. 9 is a partial cross sectional end view of the power cord retaining member taken in accordance with section line 9—9 in FIG. 6 illustrating the retaining yoke supported by opposing flanges within the housing.

The yoke component 18*a* has notches 36 that allow the rectangular surface 30 to slide in linearly extending, opposing flanges or tracks within the housing 12*a*. Referring briefly to FIGS. 8 and 9, a pair of such tracks 38 are illustrated. Tracks 38 are formed so as to project from opposing interior surfaces of the housing 12, which is typically formed with a mating, two-piece construction, to facilitate assembly of the tool 12. The tracks 38 engage the edges of the rectangular surface 30 of the retaining member 18 for sliding movement thereon.

Figure 5:
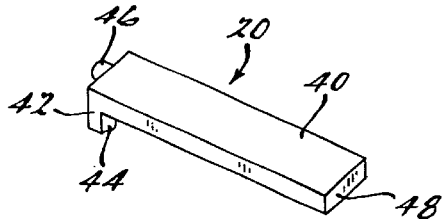
FIG. 5 is a perspective view of the release button for the power cord retaining system.
Figure 6:
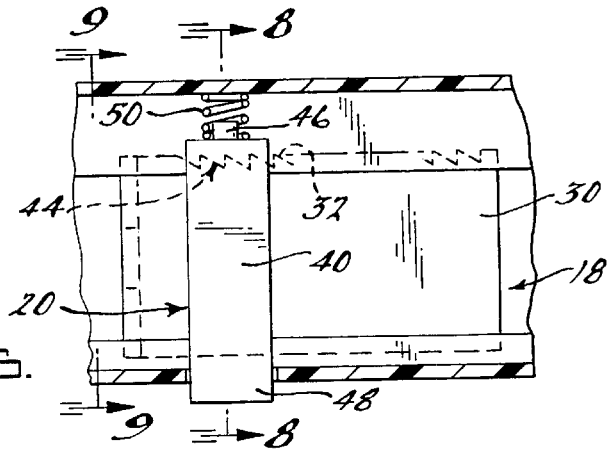
FIG. 6 is a cross sectional top view of the power tool housing of FIG. 1 depicting just the power cord retaining member with the release member engaging the retaining member.
Figure 7:
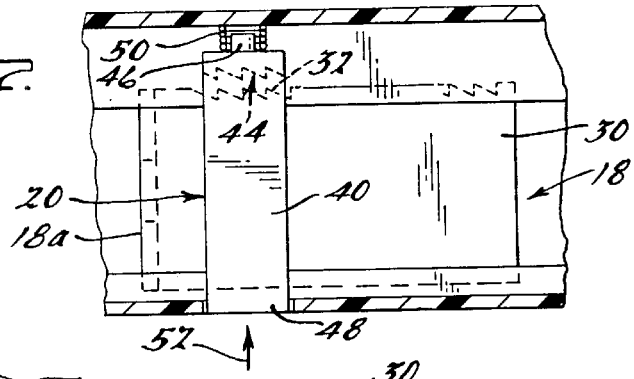
FIG. 7 is a cross sectional top view of the power tool housing of FIG. 1 depicting the power cord retaining member with the release member disengaged from the retaining member.

FIG. 5 illustrates the release member 20 of the power cord retaining system 10 in greater detail. The release member 20 has a rectangular surface component 40 and a perpendicularly extending locking arm 42. The locking arm 42 has a serrated surface 44, as also shown in FIGS. 6 and 7 by hidden lines. The release member 20 also has a boss portion 46 for holding a biasing device such as a coil spring. The opposite end of the release member 20 forms a release button 48 which allows the release member to be depressed inwardly thus disengaging the release member 20 from the retaining member 18. As shown in FIG. 1, button 48 protrudes slightly from an opening 49 in the housing 12*b* to allow easy engagement thereof by a user when the power cord 24 is to be released from the tool 12.

With brief reference to FIGS. 2 and 3, a pair of opposing ribs 39 are formed on an interior surface of the housing 12*a*. Each of the ribs 39 includes a notch 39*a* adapted to engage a corner of the rectangular portion 20*a* of the release member 20. The ribs 39 serve to guide the release member 20 for sliding movement perpendicularly to the retaining member 18.

FIGS. 6 and 7 illustrate top views of the system 10 showing the retaining member 18 with the release member 20 resting on top of the retaining member. A coil spring 50 is used to bias the release member 20 into constant contact with retaining member 18 such that the serrated surfaces 32 and 44 intergage one another. FIG. 6 shows the system 10 in the locked position. In this position the retaining member 18 is prevented from moving in the direction away from the power jack 22 (i.e., to the left) in the housing 12*a* of the power tool 12. The serrated edge 32 of the retaining member 18 is held against the serrated surface 44 of the release member 20 by the spring 50. The spring 50 is held in place against the release member 18 by the boss portion 46.

Referring briefly to FIG. 8 the release member 20 rests on top of the retaining member 18. FIG. 8 shows the system 10 in the locked position with the serrated surface 44 engaging the serrated edge 32.

FIG. 7 shows the system 10 in the unlocked position. The serrated edge 32 of the retaining member 18 is shown separated from the serrated surface of the release member 20 as a result of a force applied to the button 48 along directional line 52. This moves the serrated surface 44 of the release member 20 out of engagement with the serrated edge 32 of the retaining member 18, which allows the retaining member 18 to be moved slidably away from the power jack 22 in the housing 12*a* of the power tool 12 while the button 48 is held depressed. The spring 50 is shown in the compressed position in FIG. 7 when the release button 48 is depressed in order to unlock the system 10.

Figure 10:
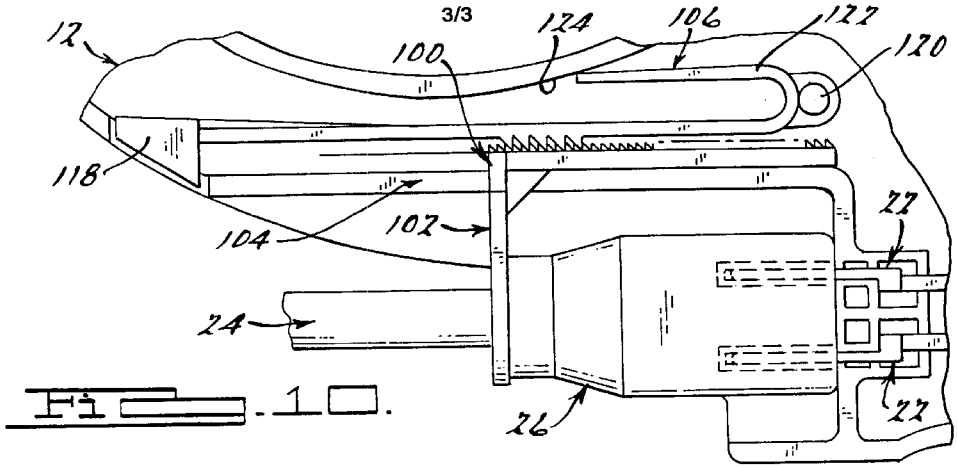
FIG. 10 is a cross section of a portion of the power tool housing depicting an alternative preferred embodiment of the power cord retaining system in the locked position holding a power cord receptacle.
Figure 11:
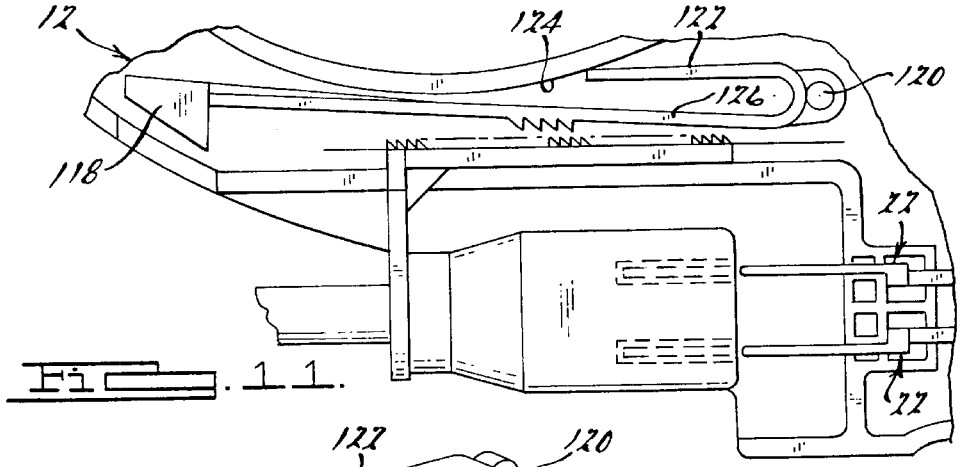
FIG. 11 shows the power tool of FIG. 9 but with the retaining system in the unlocked position.

FIGS. 10 and 11 illustrate a cord retaining system 100 in accordance with an alternative preferred embodiment of the present invention. A retaining member 102 holds the power cord female plug head 26 engaged with the AC power jack contact blades 22 in the power tool 12. The retaining member 102 slides in a track 104 of the housing 12*a*. The retaining member 102 has a serrated top surface 116.

Figure 12:
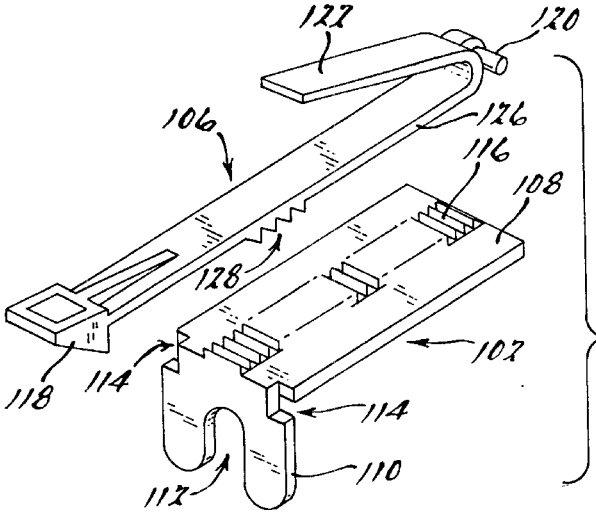
FIG. 12 is an exploded perspective view of the power cord retaining member and release member of the embodiment of FIGS. 9 and 10.

FIG. 12 illustrates a release member 106 in spaced apart relation to the retaining member 102. The retaining member 102 has a rectangular planar surface 108 and a perpendicularly extending yoke component 110. The yoke component 110 has an opening 112 large enough for the power cord 24 to fit through but small enough to prevent the plug head 26 from pulling through the yoke 110. The yoke 110 has notches 114 that allow the retaining component to slide on the tracks 38 (FIG. 9) of the power tool housing 12*a*. The retaining member 102 has a serrated surface 116 formed on the planar surface 108 thereof, rather than on an edge, as with the system 10 of the first described embodiment.

With reference to FIGS. 11 and 12, the release member 106 has a release element 118 formed at one end and a pair of mounting members 120 at the other end. An upper portion 122 of the release member 106 in contact with wall portion 124 allows a lower portion 126 thereof to be continuously urged into engagement with the retaining member 102. Release member 106 is made from plastic and has a degree of flexibility which allows the lower portion 126 to be biased into constant contact with the retaining member 102 when the tool 12 is assembled. The mounting members 120 support the release member 106 from suitable recesses (not shown) in the power tool housing 12*a*.

The release member 106 has a serrated surface 128 that engages the serrated surface 116 of the retaining member 102. When the release element 118 is depressed, as indicated in FIG. 11, it pushes the serrated surface 128 of the release member 106 away from the serrated surface 116 of the retaining member 102. While it is held in this position, the retaining member 102 can be moved slidably away from the power jack 22.

The preferred embodiments described herein provide an easy to use means for holding an electrical power cord secured to an AC power jack of a portable, AC powered tool. Advantageously, the embodiments do not require any external tools or cumbersome procedures for securing or releasing the power cord to and from an AC power jack. Furthermore, the preferred embodiments do not significantly add to the complexity of manufacture of the tool or increase significantly its cost, weight or overall dimensions. In addition, the preferred embodiments accommodate a variety of plug head shapes and sizes.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A cord retainer for retaining a power cord to a power jack disposed in a housing of a power tool comprising:

a retaining member comprising a first serrated surface, said retaining member engaging a portion of said power cord wherein said retaining member is supported by said housing and moves between a first position, wherein said power cord can be readily released from said retaining member, and a second position wherein a portion of said retaining member holds said power cord engaged to said power jack in the housing, and the retaining member cannot be moved back into said first position without operator intervention; and a release member comprising a second serrated surface, said release member being operably associated with the retaining member for holding said retaining member stationary, wherein said first serrated surface is in communication with said second serrated surface for locking said retaining member in said second position and for allowing a user to manually unlock said retaining member to thereby permit said retaining member to be moved from the second position into the first position, thus allowing said power cord to be removed from said power jack.

2. The cord retainer of claim 1, wherein said second serrated surface of said release member is biased against said first serrated surface of said retaining member by a biasing member.

3. The cord retainer of claim 2, wherein said biasing member comprises a spring.

4. The cord retainer of claim 1 wherein said release member moves slidably within said housing of said power tool between a first release position, wherein said release member lockably engages said retaining member, and a second release position wherein said release member is disengaged from said retaining member.

5. The cord retainer of claim 1, wherein said release member comprises a button that protrudes through an opening in the housing.

6. The cord retainer of claim 1, wherein said release member comprises a flexible U-shaped material, and wherein an upper portion of said release member contacts an interior wall portion of said housing and a lower portion contacts said retaining member.

7. A power tool with a power cord retaining device for retaining a power cord receptacle to the power tool, the power tool comprising:

a power tool housing comprising an electrical power jack;

a retaining member comprising a first serrated surface, the retaining member being slidably disposed within the power tool housing, wherein the retaining member moves between a retracted position in which it allows a plug of a power cord to be connected to the power jack, and a locked position wherein the retaining member holds the plug of the power cord engaged with the power jack; and a release member comprising a second serrated surface, the release member being at least partially disposed within the housing that contacts the retaining member, wherein the first serrated surface is in communication with the second serrated surface and prevents movement of the retaining member into the retracted position unless the release member is first manually urged into a release position.

8. A method for securing a power cord plug to an AC power jack of a power tool comprising the steps of:

providing a housing of the power tool comprising a power cord retaining member having a first serrated surface and a release member having a second serrated surface wherein said first serrated surface is in communication with said second serrated surface for securing said power cord plug;

engaging the release member;

while holding the release member engaged, moving the retaining member into an unlocked position wherein the plug of the power cord can be engaged with the power jack;

connecting the power cord plug to the AC power jack;

releasing the release member;

pushing the retaining member against the power cord plug; and wherein the release member prevents movement of the retaining member away from the power cord plug.

9. A cord retainer for retaining a power cord to a power jack disposed in a housing of a power tool, comprising:

a retaining member for engaging a portion of said power cord, wherein said retaining member is slidably disposed in said housing and moves along a release member between a first position, wherein said power cord can be readily released from said retaining member, and a second position wherein a portion of said retaining member holds said power cord engaged to said power jack in the housing, and the retaining member cannot be moved back into said first position without operator intervention; and the release member operably associated with the retaining member for holding said retaining member stationary and for allowing a user to manually unlock said retaining member to thereby permit said retaining member to be moved from the second position into the first position, thus allowing said retaining cord to be removed from said power jack.

* * * * *